US006428141B1

(12) United States Patent
Mc Elfresh et al.

(10) Patent No.: US 6,428,141 B1
(45) Date of Patent: Aug. 6, 2002

(54) REFERENCE DATUMS FOR INKJET PRINTHEAD ASSEMBLY

(75) Inventors: David K. Mc Elfresh, San Diego; Mohammad Akhavain, Escondido; Joseph E. Scheffelin, Poway, all of CA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/840,785

(22) Filed: Apr. 23, 2001

(51) Int. Cl.[7] ..... B41J 2/15

(52) U.S. Cl. ..... 347/40; 347/42; 347/49; 347/13

(58) Field of Search ..... 347/13, 42, 40, 347/49, 12, 43, 50, 59, 63; 29/611, 890.1; 156/299

(56) References Cited

U.S. PATENT DOCUMENTS 4,940,996 A * 7/1990 Paton et al. ..... 347/49
5,016,023 A * 5/1991 Chan et al. ..... 347/42
5,079,189 A * 1/1992 Drake et al. ..... 438/21
5,097,274 A * 3/1992 Drake et al. ..... 347/49
5,098,503 A * 3/1992 Drake ..... 156/299
5,160,945 A * 11/1992 Drake ..... 347/42
5,408,746 A * 4/1995 Thoman et al. ..... 29/890.1
5,469,199 A * 11/1995 Allen et al. ..... 347/42
5,696,544 A * 12/1997 Komuro ..... 347/50
5,719,605 A * 2/1998 Anderson et al. ..... 347/59
5,742,305 A * 4/1998 Hackleman ..... 347/42
5,755,024 A * 5/1998 Drake et al. ..... 29/611
5,946,012 A * 8/1999 Courian et al. ..... 347/63
6,062,666 A * 5/2000 Omata et al. ..... 347/12
6,315,390 B1 * 11/2001 Fujii et al. ..... 347/42

* cited by examiner

*Primary Examiner*—Lamson D. Nguyen

(57) ABSTRACT

A carrier adapted to support at least one printhead die includes a substrate having at least one surface and at least one datum attached to the at least one surface of the substrate. The substrate includes a first material and the at least one datum is formed from a blank including a second material. As such, the at least one datum is adapted to position the carrier in at least one dimension.

45 Claims, 7 Drawing Sheets

REFERENCE DATUMS FOR INKJET PRINTHEAD ASSEMBLY

THE FIELD OF THE INVENTION

The present invention relates generally to inkjet printheads, and more particularly to reference datums for positioning of an inkjet printhead assembly.

BACKGROUND OF THE INVENTION

A conventional inkjet printing system includes a printhead and an ink supply which supplies liquid ink to the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other. In one arrangement, the printhead, also referred to as a printhead die, is mounted on a carrier so as to create an inkjet printhead assembly. Typically, a mounting assembly and a media transport assembly establish relative positioning and movement of the inkjet printhead assembly and the print medium, respectively.

Positioning of the inkjet printhead assembly, however, requires proper alignment between the carrier of the inkjet printhead assembly and the mounting assembly. Unfortunately, misalignment between the carrier and the mounting assembly can adversely affect performance of the inkjet printing system. Misalignment between the carrier and the mounting assembly, for example, can result in ink drop trajectory errors, printing swath gaps, and/or pen-to-paper spacing problems which degrade print quality. Thus, in order to avoid misalignment between the carrier and the mounting assembly, relative positioning between the inkjet printhead assembly and the mounting assembly should be controlled.

Accordingly, a need exists for controlling relative positioning of an inkjet printhead assembly in a mounting assembly. In particular, a need exists for establishing reference points for a carrier of an inkjet printhead assembly.

SUMMARY OF THE INVENTION

One aspect of the present invention provides a carrier adapted to support at least one printhead die. The carrier includes a substrate having at least one surface and at least one datum attached to the at least one surface of the substrate, wherein the substrate includes a first material and the at least one datum is formed from a blank including a second material. As such, the at least one datum is adapted to position the carrier in at least one dimension.

BRIEF DESCRIPTION OF THE DRAWINGS

FIG. 7A is a top perspective view illustrating one embodiment of attaching a datum blank to the substrate;

FIG. 7B is a top perspective view illustrating one embodiment of forming one of the datums from the datum blank of FIG. 7A;

FIG. 9A is a bottom perspective view illustrating one embodiment of attaching a datum blank to the substrate; and FIG. 9B is an enlarged cross-sectional view illustrating one embodiment of the datum blank of FIG. 9A attached to the substrate.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
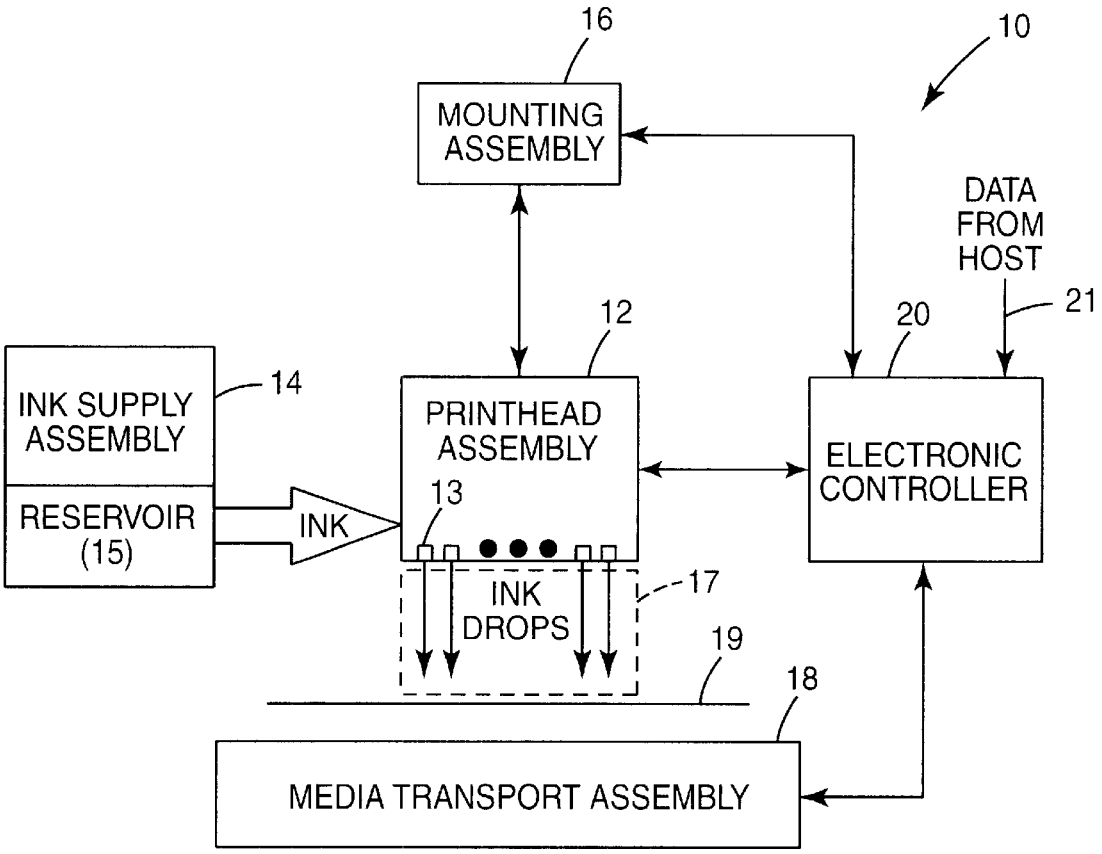
FIG. 1 is a block diagram illustrating one embodiment of an inkjet printing system according to the present invention.

FIG. 1 illustrates one embodiment of an inkjet printing system 10 according to the present invention. Inkjet printing system 10 includes an inkjet printhead assembly 12, an ink supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
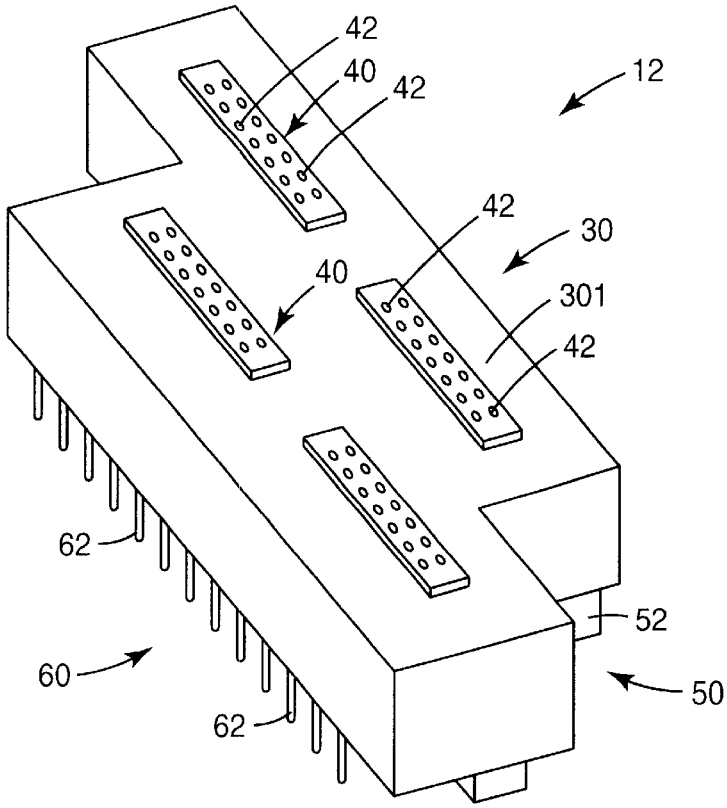
FIG. 2 is a top perspective view of one embodiment of an inkjet printhead assembly according to the present invention.
Figure 3:
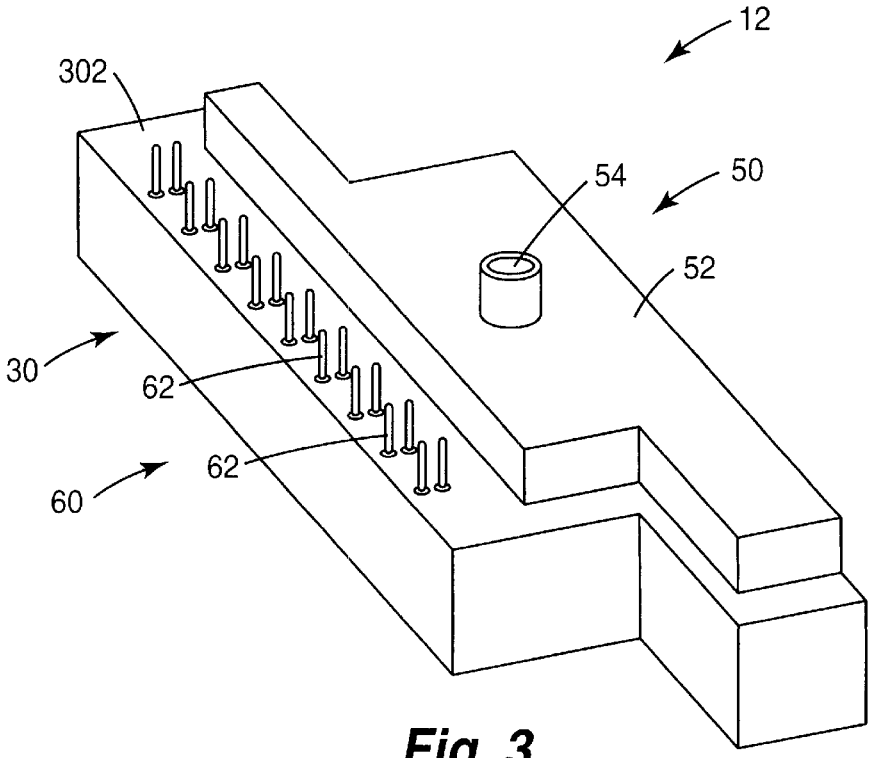
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has an exposed surface or first face 301 and an exposed surface or second face 302 which is opposite of and oriented substantially parallel with first face 301. Carrier 30 serves to carry or provide mechanical support for printhead dies 40. In addition, carrier 30 accommodates fluidic communication between printhead dies 40 and ink supply assembly 14 via ink delivery system 50 and accommodates electrical communication between printhead dies 40 and electronic controller 20 via electronic interface system 60.

Printhead dies 40 are mounted on first face 301 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead assemblies 12 are mounted in an end-to-end manner. Carrier 30, therefore, has a staggered or stair-step profile. Thus, at least one printhead die 40 of one inkjet printhead assembly 12 overlaps at least one printhead die 40 of an adjacent inkjet printhead assembly 12. While four printhead dies 40 are illustrated as being mounted on carrier 30, the number of printhead dies 40 mounted on carrier 30 may vary.

Ink delivery system 50 fluidically couples ink supply assembly 14 with printhead dies 40. In one embodiment, ink delivery system 50 includes a manifold 52 and a port 54. Manifold 52 is mounted on second face 302 of carrier 30 and distributes ink through carrier 30 to each printhead die 40. Port 54 communicates with manifold 52 and provides an inlet for ink supplied by ink supply assembly 14.

Electronic interface system 60 electrically couples electronic controller 20 with printhead dies 40. In one embodiment, electronic interface system 60 includes a plurality of electrical contacts 62 which form input/output (I/O) contacts for electronic interface system 60. As such, electrical contacts 62 provide points for communicating electrical signals between electronic controller 20 and inkjet printhead assembly 12. Examples of electrical contacts 62 include I/O pins which engage corresponding I/O receptacles electrically coupled to electronic controller 20 and I/O contact pads or fingers which mechanically or inductively contact corresponding electrical nodes electrically coupled to electronic controller 20. Although electrical contacts 62 are illustrated as being provided on second face 302 of carrier 30, it is within the scope of the present invention for electrical contacts 62 to be provided on other sides of carrier 30.

Figure 4:
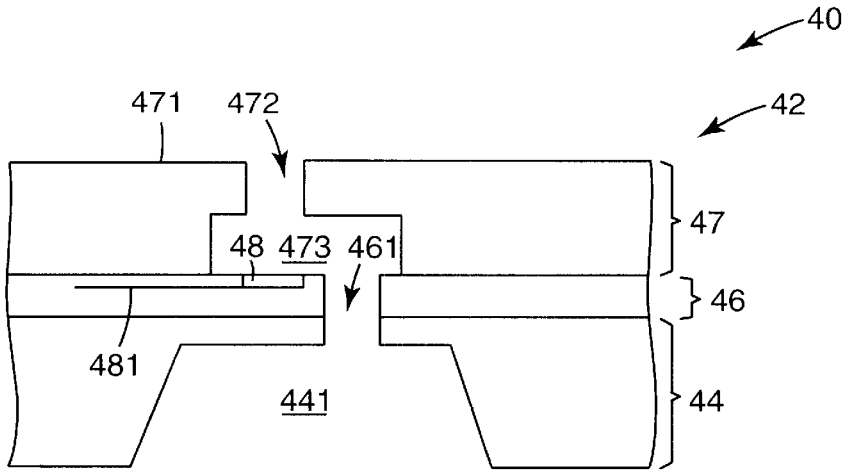
FIG. 4 is a schematic crosssectional view illustrating one embodiment of portions of a printhead die according to the present invention.

As illustrated in FIGS. 2 and 4, each printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 5:
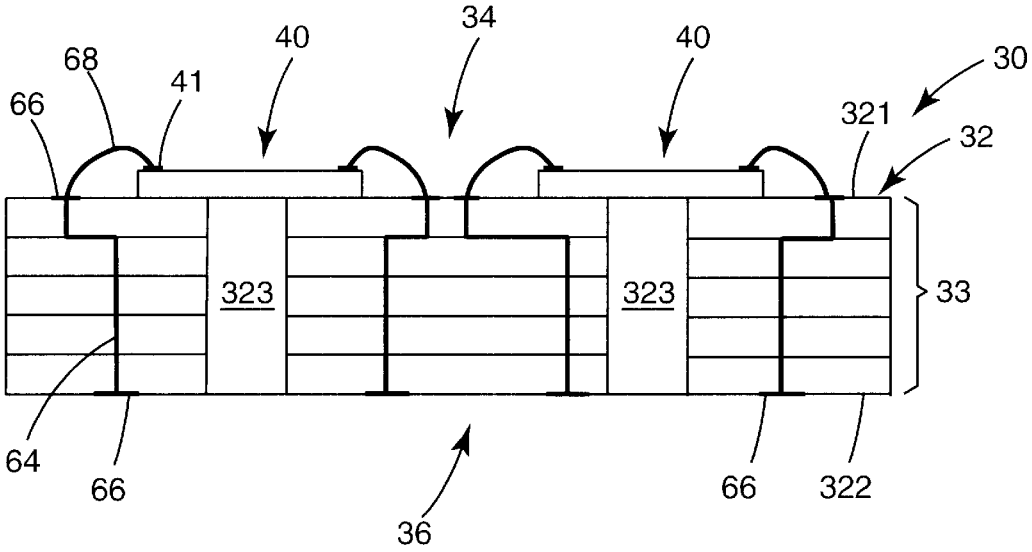
FIG. 5 is a schematic cross-sectional view illustrating one embodiment of a substrate according to the present invention.

Referring to FIG. 5, carrier 30 includes a substrate 32 which is generally rectangular in cross-section. In one embodiment, substrate 32 has a first side 321 and a second side 322 which is opposite first side 321. As such, printhead dies 40 are disposed on first side 321 and ink manifold 52 is disposed on second side 322. Substrate 32 provides and/or accommodates mechanical, electrical, and fluidic functions of inkjet printhead assembly 12. More specifically, substrate 32 provides mechanical support for printhead dies 40, accommodates fluidic communication between ink supply assembly 14 and printhead dies 40 via ink delivery system 50, and accommodates electrical connection between printhead dies 40 and electrical controller 20 via electronic interface system 60. In addition, substrate 32 facilitates positioning of inkjet printhead assembly 12 in mounting assembly 16, as described below.

For transferring ink between ink supply assembly 14 and printhead dies 40, substrate 32 has at least one ink passage 323 formed therein. Ink passage 323 extends through substrate 32 and provides a through-channel or through-opening for delivery of ink to printhead dies 40 from ink manifold 52. As such, one end of ink passage 323 communicates with manifold 52 of ink delivery system 50 and another end of ink passage 323 communicates with printhead dies 40 and, more specifically, ink feed slot 441 of substrate 44 (FIG. 4). Thus, ink passage 323 forms a portion of ink delivery system 50. Although only one ink passage 323 is shown for a given printhead die 40, additional ink passages to the same printhead die may be provided, for example, to supply ink of respective differing colors.

For transferring electrical signals between electronic controller 20 and printhead dies 40, electronic interface system 60 includes a plurality of conductive paths 64 extending through substrate 32. More specifically, substrate 32 includes conductive paths 64 which pass through and terminate at exposed surfaces of substrate 32. In one embodiment, conductive paths 64 include electrical contact pads 66 at terminal ends thereof which form, for example, I/O bond pads on substrate 32. Conductive paths 64, therefore, terminate at and provide electrical coupling between electrical contact pads 66.

Electrical contact pads 66 define a first interface 34 and a second interface 36 of substrate 32. As such, first interface 34 and second interface 36 provide points for electrical connection to substrate 32 and, more specifically, conductive paths 64. Electrical connection is established, for example, via electrical connectors or contacts 62, such as I/O pins or spring fingers, wire bonds, electrical nodes, and/or other suitable electrical connectors.

In one embodiment, printhead dies 40 include electrical contacts 41 which form I/O bond pads. As such, electronic interface system 60 includes electrical connectors, for example, wire bond leads 68, which electrically couple electrical contact pads 66 of first interface 34 with electrical contacts 41 of printhead dies 40.

Conductive paths 64 transfer electrical signals between electronic controller 20 and printhead dies 40. More specifically, conductive paths 64 define transfer paths for power, ground, and data among and/or between printhead dies 40 and electrical controller 20. In one embodiment, data includes print data and non-print data. Print data includes, for example, nozzle data containing pixel information such as bitmap print data. Non-print data includes, for example, command/status (CS) data, clock data, and/or synchronization data. Status data of CS data includes, for example, printhead temperature or position, print resolution, and/or error notification.

In one embodiment, as illustrated in FIG. 5, conductive paths 64 terminate at first side 321 and second side 322 of substrate 32. Thus, electrical contact pads 66 are provided on first side 321 and second side 322 of substrate 32. As such, conductive paths 64 provide electrical coupling between electrical contact pads 66 on second side 322 of substrate 32 and electrical contact pads 66 on first side 321 of substrate 32. First interface 34 and second interface 36, therefore, are provided on first side 321 and second side 322, respectively. Accordingly, electrical contacts 62 are electrically coupled at one end to electrical contact pads 66 provided on second side 322 and wire bond leads 68 are electrically coupled at one end to electrical contact pads 66 provided on first side 321 and at another end to electrical contacts 41 of printhead dies 40.

While conductive paths 64 are illustrated as terminating at first side 321 and second side 322 of substrate 32, it is, however, within the scope of the present invention for conductive paths 64 to terminate at other sides of substrate 32. In addition, one or more conductive paths 64 may branch from and/or lead to one or more other conductive paths 64. Furthermore, one or more conductive paths 64 may begin and/or end within substrate 32. Conductive paths 64 may be formed as described, for example, in U.S. patent application Ser. No. 09/648,565, entitled "Wide-Array Inkjet Printhead Assembly with Internal Electrical Routing System" assigned to the assignee of the present invention and incorporated herein by reference.

In one embodiment, substrate 32 includes a plurality of layers 33 each formed of a ceramic material. As such, substrate 32 includes circuit patterns which pierce layers 33 to form conductive paths 64. In one fabrication methodology, circuit patterns are formed in layers of unfired tape (referred to as green sheet layers) using a screen printing process. The green sheet layers are made of ceramic particles in a polymer binder. Alumina may be used for the particles, although other oxides or various glass/ceramic blends may be used. Each green sheet layer receives conductor lines and other metallization patterns as needed to form conductive paths 64. Such lines and patterns are formed with a refractory metal, such as tungsten, by screen printing on the corresponding green sheet layer. Thus, conductive and non-conductive or insulative layers are formed in substrate 32.

Conductive paths 64 extend from one layer to the next through via holes punched out from the green sheet and filled in, for example, with a tungsten paste. Thus, circuit patterns including metallized or conductive layers are formed in substrate 32. Openings in substrate 32, such as ink passages 323, are formed by punching holes and cavities of desired size and shape through the green sheet. Once each layer 33 has received the desired metallization, vias, and openings, layers 33 are stacked in the desired configuration.

It is to be understood that FIG. 5 is a simplified schematic illustration of substrate 32. The illustrative routing of ink passages 323 and conductive paths 64 through substrate 32, for example, has been simplified for clarity of the invention. Although various features of substrate 32, such as ink passages 323 and conductive paths 64, are schematically illustrated as being straight, it is understood that design constraints could make the actual geometry more complicated for a commercial embodiment of inkjet printhead assembly 12. Ink passages 323, for example, may have more complicated geometries to allow multiple colorants of ink to be channeled through carrier 30. In addition, conductive paths 64 may have more complicated routing geometries through substrate 32 to avoid contact with ink passages 323 and to allow for electrical connector geometries other than the illustrated I/O pins. It is understood that such alternatives are within the scope of the present invention.

Figure 6:
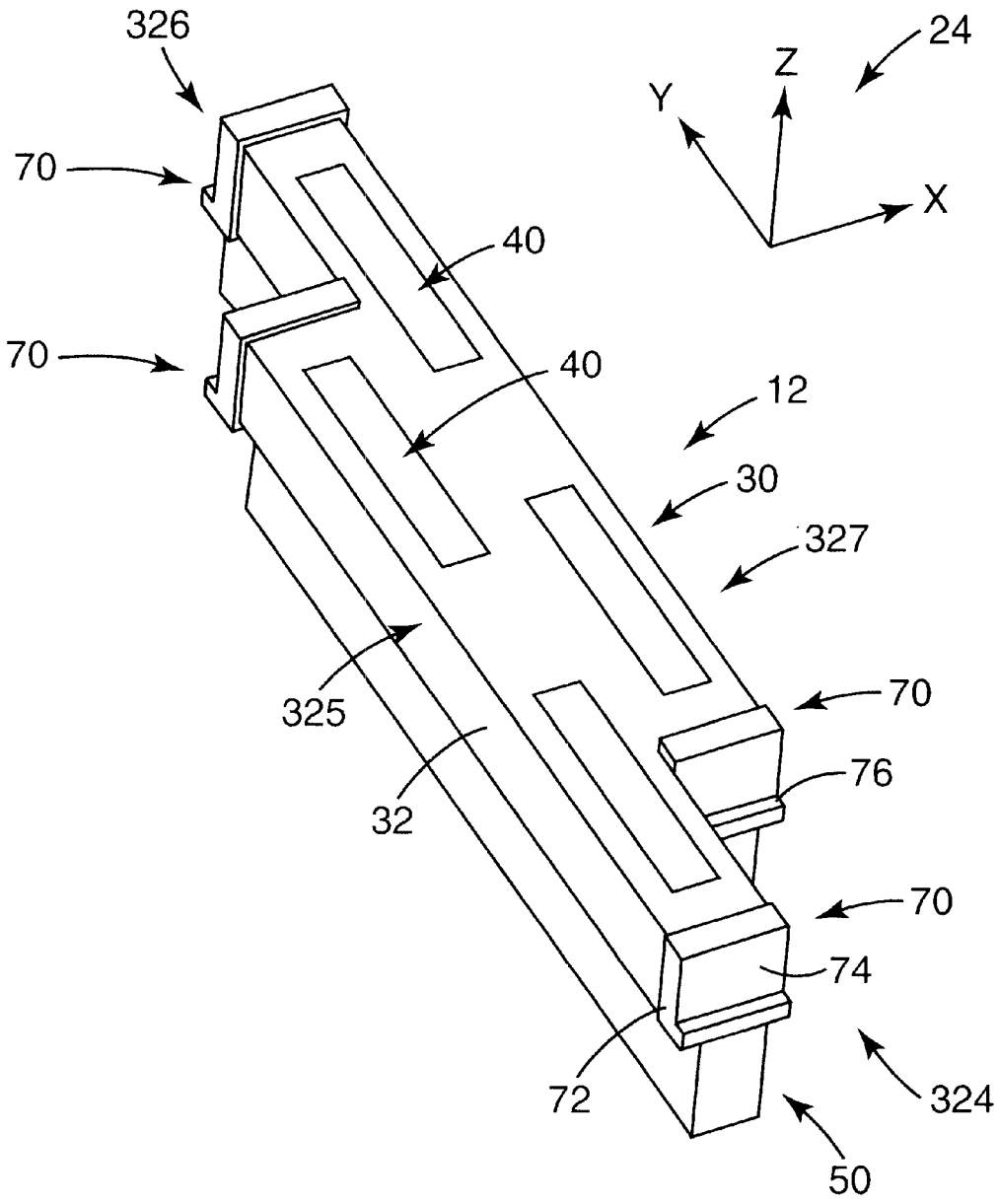
FIG. 6 is a top perspective view illustrating one embodiment of an inkjet printhead assembly including a plurality of datums attached to a substrate according to the present invention.

Referring to FIG. 6, inkjet printhead assembly 12 has an x-axis in an x dimension, a y-axis in a y dimension, and a z-axis in a z dimension, as indicated by arrows 24. In one embodiment, the x-axis represents a scanning axis of inkjet printhead assembly 12 and the y-axis represents a paper axis of inkjet printhead assembly 12. More specifically, the x-axis extends in a direction coinciding with relative side-to-side movement of inkjet printhead assembly 12 during printing and the y-axis extends in a direction coinciding with relative advancement between print medium 19 and inkjet printhead assembly 12 during printing.

The z-axis of inkjet printhead assembly 12 extends in a direction substantially perpendicular to front face 471 of printhead dies 40 (FIG. 4). More specifically, the z-axis extends in a direction coinciding with ink drop ejection from printhead dies 40 during printing. Thus, spacing between inkjet printhead assembly 12 and print medium 19, referred to as pen-to-paper spacing, is measured along the z-axis. Pen-to-paper spacing, therefore, is controlled by relative positioning of inkjet printhead assembly 12 along the z-axis.

As described above, mounting assembly 16 positions inkjet printhead assembly 12 relative to media transport assembly 18. As such, inkjet printhead assembly 12 is mounted within and positioned relative to mounting assembly 16. Mounting assembly 16, therefore, positions inkjet printhead assembly 12 with reference to the x-axis, the y-axis, and the z-axis thereof.

In one embodiment, to position inkjet printhead assembly 12 in x, y, and z dimensions, inkjet printhead assembly 12 includes a plurality of datums 70. As such, datums 70 establish reference points for positioning of inkjet printhead assembly 12. Thus, when inkjet printhead assembly 12 is mounted within mounting assembly 16, datums 70 contact corresponding and/or complementary portions of mounting assembly 16. Mounting of inkjet printhead assembly 12 in mounting assembly 16 is described, for example, in U.S. patent application Ser. No. 09/648,121, entitled "Carrier Positioning for Wide-Array Inkjet Printhead Assembly" assigned to the assignee of the present invention and incorporated herein by reference. Datums 70 may also be used to position inkjet printhead assembly 12 during manufacture and/or assembly of inkjet printhead assembly 12.

Datums 70 include an x-datum 72, a y-datum 74, and a z-datum 76. As such, x-datum 72, y-datum 74, and z-datum 76 contact mounting assembly 16 when inkjet printhead assembly 12 is mounted within mounting assembly 16. Thus, x-datum 72, y-datum 74, and z-datum 76 position carrier 30 and, therefore, inkjet printhead assembly 12 relative to mounting assembly 16 along the x axis, the y axis, and the z axis, respectively, of inkjet printhead assembly 12.

As illustrated in FIG. 6, substrate 32 includes sides 324, 325, 326, and 327. In one embodiment, sides 324 and 326 are opposite of and oriented substantially parallel with each other and sides 325 and 327 are opposite of and oriented substantially parallel with each other. In addition, sides 324, 325, 326, and 327 are oriented substantially perpendicular to sides 321 and 322. As such, datums 70 are provided at opposite sides 324 and 326 of substrate 32.

Figure 7A:
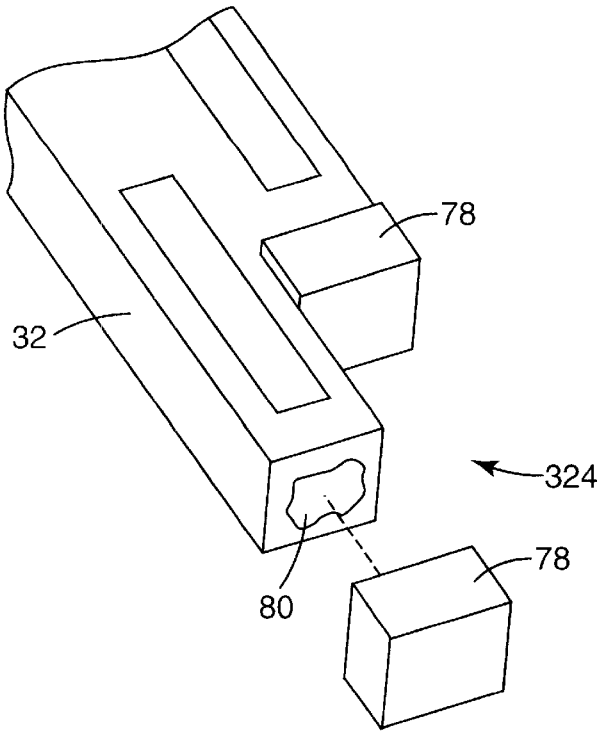
FIGS. 7A and 7B illustrate one embodiment of a method of forming the datums on the substrate of the inkjet printhead assembly of FIG. 6.
Figure 7B:
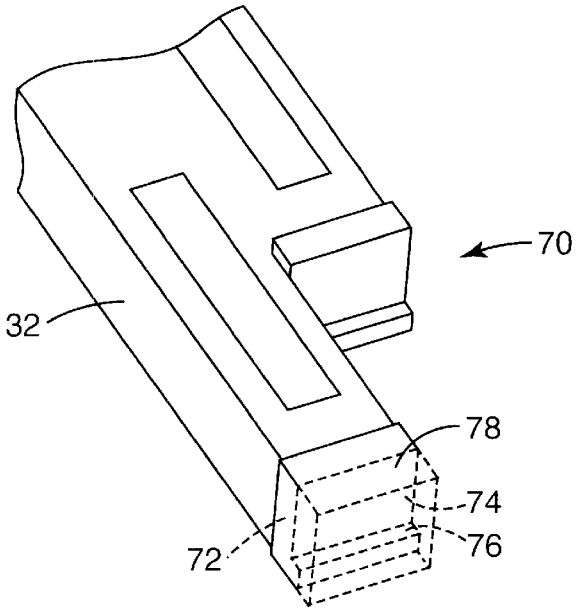

FIGS. 7A and 7B illustrate one embodiment of a method of forming datums 70 for inkjet printhead assembly 12. To form datums 70 for inkjet printhead assembly 12, substrate 32 is provided and a plurality of datum blanks 78 are attached to substrate 32, as illustrated in FIG. 7A. In one embodiment, datum blanks 78 are attached to opposite sides 324 and 326 of substrate 32. As such, sides 324 and 326 of substrate 32 form bond regions to which datum blanks 78 are attached. While datum blanks 78 are described as being attached to sides 324 and 326, it is within the scope of the present invention for datum blanks 78 to be attached to other sides and/or surfaces of substrate 32.

In one embodiment, substrate 32 includes an inorganic glass or ceramic material such as aluminum oxide (Alumina), aluminum nitride, silicon carbide, silicon nitride, beryllium oxide, boron nitride, or other suitable ceramic material. In addition, datum blanks 78 and, therefore, datums 70 are formed of a plastic material such as polyphenylene sulfide (PPS), liquid crystal polymer (LCP), Noryl, nylon or other suitable plastic material. As such, datum blanks 78 are attached to substrate 32 with an epoxy or adhesive 80 such as cyanoacrylate which is disposed on substrate 32 and/or datum blanks 78. While substrate 32 is illustrated in FIG. 5 as being formed of multiple layers, it is within the scope of the present invention for substrate 32 to be formed of one or more layers. In addition, substrate 32 may also be formed of silicon or metal such as a high strength or hardened steel.

In one illustrative embodiment, substrate 32 includes multiple layers of a ceramic material such as Alumina and datum blanks 78 are formed of a plastic material such as PPS. As such, substrate 32 has a hardness greater than that of datum blanks 78. Thus, substrate 32 is formed of a "hard" material relative to datums 70 and datums 70 are formed of a "soft" material relative to substrate 32. In the illustrative embodiment, datum blanks 78 are attached to substrate 32 with an adhesive such as Emerson and Cuming's 3032 adhesive.

As a hard material, substrate 32 is difficult and/or expensive to machine to required tolerances because, for example, the material causes tool wear or breakage, the material is brittle and, therefore, breaks easily, and/or the material will not retain dimensional tolerances. Thus, datums 70 are preferably formed of a material which can be machined with high yields and low tool wear and breakage, a material which maintains dimensional tolerances, and a material which is resistant to corrosion and thermal expansion.

Next, as illustrated in FIG. 7B, datums 70 are formed from datum blanks 78. In one embodiment, datums 70 are formed by selectively removing portions of datum blanks 78. As such, x-datum 72, y-datum 74, and z-datum 76 are formed as excess material is removed from datum blanks 78.

Material is removed from datum blanks 78 by, for example, grinding, milling, or other machining techniques. Thus, datum blanks 78 are formed of a material which facilitates forming of datums 70.

While the above description only refers to forming of datums 70 on substrate 32 of inkjet printhead assembly 12 which includes a plurality of printhead dies 40, it is understood that the present invention is applicable to forming of datums for inkjet printhead assemblies which include one or more printhead dies 40. In addition, the present invention is also applicable to forming of datums 70 on other substrates which, for example, are difficult or expensive to machine because they cause tool wear or breakage, are brittle or break easily, or will not retain dimensional tolerances. Furthermore, datums 70 may be formed from datum blanks 78 before as well as after being attached to substrate 32.

Figure 8:
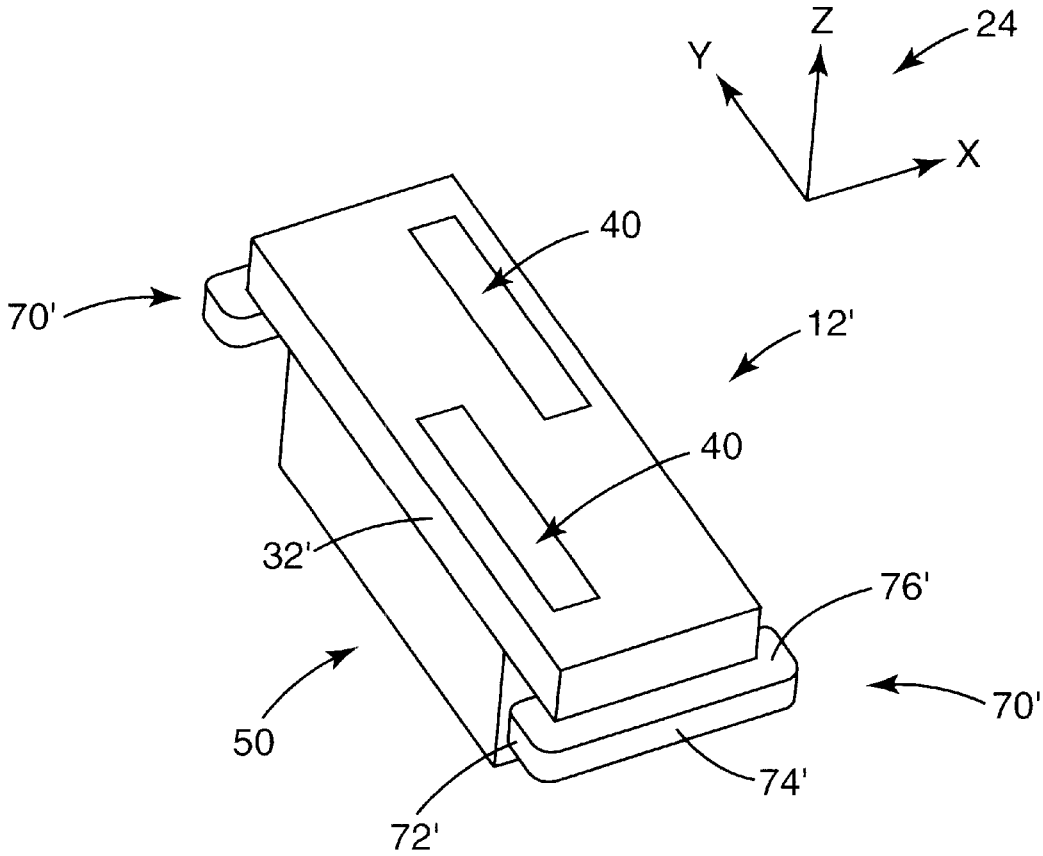
FIG. 8 is a top perspective view illustrating another embodiment of an inkjet printhead assembly including a plurality of datums attached to a substrate according to the present invention.

FIG. 8 illustrates another embodiment of inkjet printhead assembly 12. Inkjet printhead assembly 12' includes a substrate 32' similar to substrate 32 of inkjet printhead assembly 12 and has x, y, and z axes in x, y, and z dimensions, respectively, similar to inkjet printhead assembly 12, as indicated by arrows 24.

To position inkjet printhead assembly 12' in x, y, and z dimensions, inkjet printhead assembly 12' includes a plurality of datums 70'. Datums 70' include an x-datum 72', a y-datum 74', and a z-datum 76'. Datums 70' establish reference points for positioning of inkjet printhead assembly 12' in a manner similar to that described above with regards to datums 70 of inkjet printhead assembly 12.

Figure 9A:
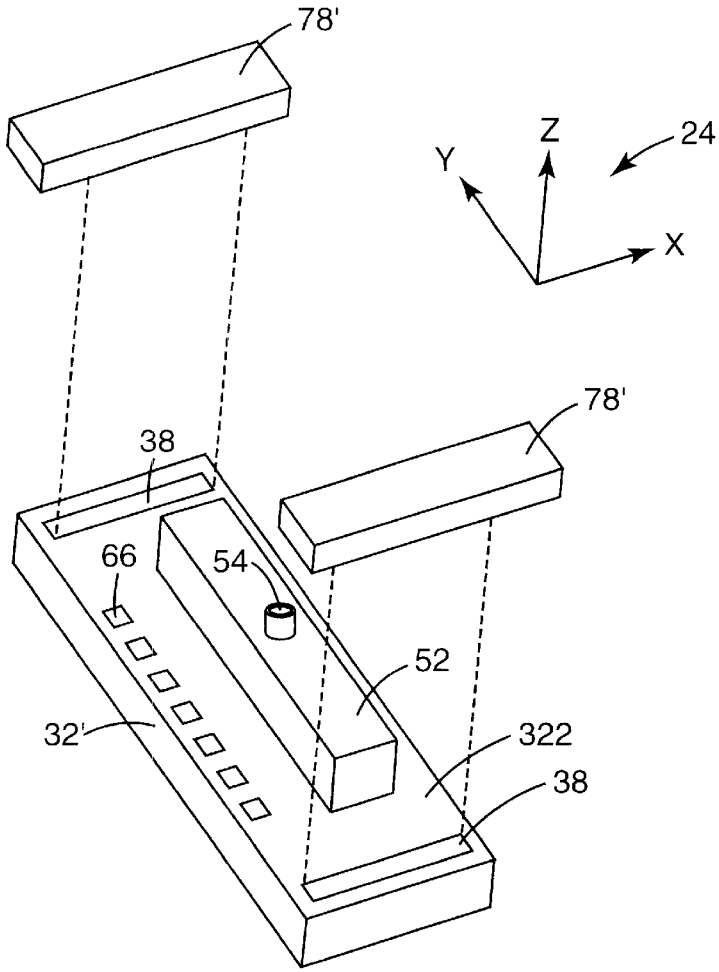
FIGS. 9A and 9B illustrate one embodiment of a method of forming the datums on the substrate of the inkjet printhead assembly of FIG. 8.
Figure 9B:
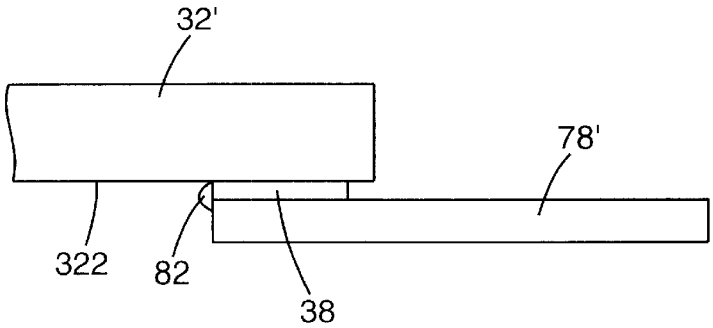

FIGS. 9A and 9B illustrate one embodiment of a method of forming datums 70' for inkjet printhead assembly 12'. To form datums 70' for inkjet printhead assembly 12', substrate 32' is provided and a plurality of datum blanks 78' are attached to substrate 32', as illustrated in FIG. 9A. In one embodiment, substrate 32' includes one or more bond pads 38 to which datum blanks 78' are attached.

Bond pads 38 are formed on a surface of substrate 32' and provide points for connection to substrate 32'. As such, bond pads 38 form bond regions of substrate 32' to which datum blanks 78' are attached. In one embodiment, bond pads 38 are formed on second side 322 of substrate 32'. While bond pads 38 are illustrated as being provided on second side 322 of substrate 32', it is within the scope of the present invention for bond pads 38 to be formed on other surfaces and/or sides of substrate 32'.

In one embodiment, substrate 32' includes a ceramic material as described above with reference to substrate 32 and datum blanks 78' are formed of metal. As such, bond pads 38 of substrate 32' are also formed of metal. Thus, datum blanks 78' are attached to bond pads 38 by, for example, soldering, brazing, or welding, or other bonding techniques such as ultrasonic, thermosonic, or thermocompression bonding.

Datum blanks 78' are formed, for example, of stainless steel, copper-tungsten, Kovar, Alloy 42, mild steel, aluminum, brass, or other suitable metal or alloy. In addition, bond pads 38 of substrate 32' are formed, for example, of stacked layers of metal including tungsten or molybdenum, nickel, and/or gold, lead-tin, or copper. As such, tungsten or molybdenum form a base of bond pads 38 and gold, lead-tin, or copper form a bond surface of bond pads 38. Bond pads 38 of substrate 32' may also be formed of another suitable metal or alloy based on an intended attachment method.

In one illustrative embodiment, substrate 32' includes multiple layers of a ceramic material such as Alumina and bond pads 38 are formed of stacked layers of metal such as tungsten, nickel, and gold with tungsten forming a base of bond pads 38 and gold forming a bond surface of bond pads 38. In addition, datum blanks 78' are formed of metal such as copper-tungsten and are soldered to bond pads 38 with gold-tin solder. As such, substrate 32' has a hardness greater than that of datum blanks 78'.

As illustrated in FIG. 9B, datum blanks 78' are attached to bond pads 38 provided on second side 322 of substrate 32'. Datum blanks 78' are, for example, soldered, welded, brazed, bonded, or adhered to bond pads 38, as represented by bond 82. Thereafter, datums 70' are formed from datum blanks 78' in a manner similar to that described above with regards to datums 70 of inkjet printhead assembly 12.

By forming substrate 32 (including substrate 32') of a hard material such as ceramic and, more specifically, multiple layers of ceramic material, substrate 32 provides a surface for mounting of printhead dies 40 which is dimensionally stable and substantially planar. Furthermore, by forming substrate 32 of multiple layers of ceramic material, intricate electrical routing for printhead dies 40 can be achieved with substrate 32. For example, complicated traces of conductive material for conductive paths 64 can be easily formed with layers 33 of substrate 32.

With substrate 32 formed of a bard material such as ceramic, however, forming datums 70 (including datums 70') directly in substrate 32 is difficult. For example, ceramic material is typically difficult and costly to machine. In addition, ceramic material often cannot be machined to the tolerances required for datums 70. Plastic and metal, however, may be easily machined with conventional machining techniques. Thus, by forming substrate 32 of ceramic material and by attaching datum blanks 78 formed of plastic or metal to substrate 32, the advantages of forming substrate 32 of ceramic material are retained while the forming of datums 70 is facilitated. More specifically, with datum blanks 78 formed of plastic or metal, datums 70 can be formed using conventional machining equipment and techniques such as an end mill process.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A carrier adapted to support at least one painthead die, the carrier comprising:

a substrate having at least one surface; and at least one datum attached to the at least one surface of the substrate, the at least one datum adapted to position tee carrier in at least one dimension, wherein the substrate includes a first material and the at least one datum is formed from a blank including a second material.

2. The carrier of claim 1, wherein the first material has a first hardness and the second material has a second hardness, wherein the first hardness is greater than the second hardness.

3. The carrier of claim 1, wherein the first material includes a ceramic material.

4. The carrier of claim 3, wherein the second material includes one of plastic and metal.

5. The carrier of claim 4, wherein the substrate includes a plurality of layers of the first material.

6. The carrier of claim 1, wherein the substrate includes a bond region provided on the at least one surface thereof, wherein the bond region includes a third material, and wherein the at least one datum is joined to the third material.

7. The carrier of claim 6, wherein the second material and the third material each include metal.

8. The carrier of claim 1, wherein the at least one datum is at least one of soldered, welded, brazed, bonded, and adhered to the substrate.

9. The carrier of claim 1, wherein a portion of the blank is selectively removed to form the at least one datum.

10. A method of forming a carrier for at least one printhead die, the method comprising the steps of:

providing a substrate having at least one surface; and attaching at least one datum to the at least one surface of the substrate, wherein the at least one datum is adapted to position the carrier in at least one dimension, and wherein the substrate includes a first material and the at least one datum is formed from a blank including a second material.

11. The method of claim 10, wherein the first material has a first hardness and the second material has a second hardness, wherein the first hardness is greater than the second hardness.

12. The method of claim 10, wherein the first material includes a ceramic material.

13. The method of claim 12, wherein the second material includes one of plastic and metal.

14. The method of claim 13, wherein the substrate includes a plurality of layers of the first material.

15. The method of claim 10, wherein the substrate has at least one bond region provided on the at least one surface thereof, wherein the at least one bond region includes a third material, and wherein the step of attaching the at least one datum includes joining the at least one datum to the third material of the at least one bond region.

16. The method of claim 15, wherein the second material and the third material each include metal.

17. The method of claim 10, wherein the step of attaching the at least one datum includes at least one of soldering, welding, brazing, bonding, and adhering the at least one datum to the substrate.

18. The method of claim 10, wherein the step of attaching the at least one datum includes attaching the blank formed of the second material to the at least one surface of the substrate and forming the at least one datum from the blank.

19. The method of claim 18, wherein forming the at least one datum includes selectively removing a portion of the blank.

20. The method of claim 18, wherein forming the at least one datum includes establishing at least one of an x-datum a y-datum, and a z-datum for the substrate.

21. The method of claim 18, wherein forming the at least one datum includes forming the at least one datum from the blank before attaching the blank to the at least one surface of the substrate.

22. The method of claim 18, wherein forming the at least one datum includes forming the at least one datum from the blank after attaching the blank to the at least one surface of the substrate.

23. An inkjet printhead assembly, comprising:

a carrier including a substrate and at least one datum attached to the substrate, the at least datum adapted to position the carrier in at least one dimension; and at least one printhead die mounted on the carrier, wherein the substrate includes a first material and the at least one datum is formed from a blank including a second material.

24. The inkjet printhead assembly of claim 23, wherein the first material has a first hardness and the second material has a second hardness, wherein the first hardness is greater than the second hardness.

25. The inkjet printhead assembly of claim 23, wherein the first material includes a ceramic material.

26. The inkjet printhead assembly of claim 25, wherein the second material includes one of plastic and metal.

27. The inkjet printhead assembly of claim 26, wherein the substrate includes a plurality of layers of the first material.

28. The inkjet printhead assembly of claim 23, wherein the substrate includes a bond region provided on the at least one surface thereof, wherein the bond region includes a third material, and wherein the at least one datum is joined to the third material.

29. The inkjet printhead assembly of claim 28, wherein We second material and the third material each include metal.

30. The inkjet printhead assembly of claim 23, wherein the at least one datum is at least one of soldered, welded, brazed, bonded, and adhered to the substrate.

31. The inkjet printhead assembly of claim 23, wherein the carrier has at least one ink passage extending therethrough, wherein the at least one ink passage communicates with the at least one printhead die.

32. The inkjet printhead assembly of claim 31, wherein the carrier has at least one conductive path extending therethrough, wherein the at least one printhead die is electrically coupled to the at least one conductive path.

33. The inkjet printhead assembly of claim 23, wherein the at least one printhead die includes a plurality of printhead dies.

34. The inkjet printhead assembly of claim 23, wherein a portion of the blank is selectively removed to form the at least one datum.

35. A method of providing at least one reference datum formed of a first material on at least one surface of a substrate including a second material, the method comprising the steps of:

attaching a blank formed of the first material to the at least one surface of the substrate; and selectively removing a portion of the blank to establish the at least one reference datum.

36. The method of claim 35, wherein the first material has a first hardness and the second material has a second hardness greater than the first hardness.

37. The method of claim 35, wherein the second material includes a ceramic material.

38. The method of claim 37, wherein the first material includes one of plastic and metal.

39. The method of claim 38, wherein the substrate includes a plurality of layers of the first material.

40. The method of claim 35, wherein the at least one surface of the substrate includes a bond region formed of a third material, wherein the step of attaching the blank includes attaching the blank to the third material.

41. The method of claim 40, wherein the first material and the third material each include metal.

42. The method of claim 35, wherein the step of attaching the blank includes one of soldering, welding, brazing, bonding, and adhering the blank to the substrate.

43. The method of claim 35, wherein the substrate is adapted to support at least one printhead die of an inkjet printhead assembly.

44. The method of claim 35, wherein selectively removing the portion of the blank to establish the at least one reference datum includes selectively removing the portion of the blank before attaching t blank to the at least one surface of the substrate.

45. The method of claim 35, wherein selectively removing the portion of the blank to establish the at least one reference datum includes selectively removing the portion of the blank after attaching the blank to the at least one surface of the substrate.

* * * * *

UNITED STATES PATENT AND TRADEMARK OFFICE

CERTIFICATE OF CORRECTION

PATENT NO. : 6,428,141 B1
DATED : August 6, 2002
INVENTOR(S) : David K. Mc Elfresh et al.

It is certified that error appears in the above-identified patent and that said Letters Patent is hereby corrected as shown below:

Column 10,
Line 55, “painthead” should read -- printhead --;
Line 60, “tee” should read -- the --;

Column 12,
Line 26, “We” should read -- the --;

Column 14,
Line 1, “t” should read -- the --.

Signed and Sealed this

Eighteenth Day of February, 2003

JAMES E. ROGAN
*Director of the United States Patent and Trademark Office*